United States Patent [19]

Billmayer et al.

[11] Patent Number: 4,668,196

[45] Date of Patent: May 26, 1987

[54] MANUALLY POWERED BOAT

[75] Inventors: Charles E. Billmayer; Robert P. Koch, both of East Grand Rapids, Mich.

[73] Assignee: Leisure Life Limited, Grand Rapids, Mich.

[21] Appl. No.: 833,348

[22] Filed: Feb. 25, 1986

[51] Int. Cl.[4] ..... B63H 5/02

[52] U.S. Cl. ..... 440/26; 440/27; 440/90; 114/61

[58] Field of Search ..... 440/26–31, 440/90, 91, 92, 93; 114/61, 58, 147, 363; D12/300, 306, 310; 74/594.1, 594.4; 280/259, 231

[56] References Cited

U.S. PATENT DOCUMENTS

| | | | |
|---|---|---|---|
| 94,818 | 9/1869 | Haberland . | |
| D. 151,382 | 10/1948 | Melton | D71/1 |
| D. 195,706 | 7/1963 | Siegel | D71/1 |
| D. 215,038 | 8/1969 | Reeder et al. | D71/1 |
| D. 220,222 | 3/1971 | Nolet | D71/1 |
| D. 221,405 | 8/1971 | Schropfer | D71/1 |
| D. 221,809 | 9/1971 | Love | D71/1 |
| D. 241,327 | 9/1976 | Compton | D12/68 |
| D. 246,517 | 11/1977 | Deputy | D12/68 |
| D. 263,464 | 3/1982 | Walker | D12/306 |
| D. 267,003 | 11/1982 | Lacasse | D12/306 |
| D. 269,507 | 6/1983 | Sabelhouse, Jr. et al. | D12/306 |
| D. 280,498 | 9/1985 | Lacasse | D12/306 |
| 596,685 | 1/1898 | Quist et al. . | |
| 645,807 | 3/1900 | Guffey . | |
| 1,071,709 | 9/1913 | Cracroft . | |
| 1,178,649 | 4/1916 | Koenig . | |
| 1,566,741 | 12/1925 | Forse | 280/259 |
| 2,165,745 | 7/1939 | Canton | 115/26 |
| 2,930,340 | 3/1960 | Sessions | 115/1 |
| 2,998,798 | 9/1961 | Love | 115/23 |
| 3,031,692 | 5/1962 | Riek | 9/1 |
| 3,410,244 | 11/1968 | Graham | 115/23 |
| 3,572,816 | 3/1971 | Brown | 296/63 |
| 3,800,734 | 4/1974 | Whang | 115/31 |
| 4,140,076 | 2/1979 | Borglum | 115/26 |
| 4,318,700 | 3/1982 | Price | 440/26 |
| 4,323,352 | 4/1982 | Warren et al. | 440/27 |
| 4,376,420 | 3/1983 | Fracarossi | 440/91 |

FOREIGN PATENT DOCUMENTS

| | | | |
|---|---|---|---|
| 893745 | 10/1944 | France . | |
| 984997 | 7/1951 | France . | |
| 7424459 | 2/1976 | France | 440/26 |
| 543925 | 3/1956 | Italy . | |
| 11565 | of 1912 | United Kingdom . | |

OTHER PUBLICATIONS

Brochure, Pedal Powered Sailboat, Sunkyong International, Inc., New York, New York.

Brochure, Sea Ryder, Godfrey Marine, Elkhart, Indiana 46516, copyright 1985.

Brochure and letter, Ofira Personal Folding Pedal Boat, O.D.T. Ltd., Ramle, Israel.

*Design* Magazine, Nov. 1980, p. 46.

"Seabike" brochure, distributed by Lighttown Constructions, Eindhoven, The Netherlands.

Brochure, Model DL-120 Deluxe Pedal Boat, Martin Manufacturing Inc., Albert Lea, Minnesota 56007, copyright 1984.

Brochure, Pelican—The Wings of Fun, Pelican International Inc., Laval, Quebec, Canada H7P2N8.

Brochure, Sea Runner, Godfrey Marine, Elkhart, Ind. 46515.

U.S. patent application, Ser. No. 739,519, filed May 31, 1985 entitled "Pontoon Vehicle"

*Primary Examiner*—Joseph F. Peters, Jr.

*Assistant Examiner*—Edwin L. Swinehart

*Attorney, Agent, or Firm*—Price, Heneveld, Cooper, DeWitt & Litton

[57] ABSTRACT

A manually powered boat for use as desired by one, two, three or more operators is disclosed. Balanced floatation is maintained regardless of the number of occupants/operators. The boat includes a buoyant hull, a centered, rotatable propulsion assembly enclosed in a housing, and a seat for at least three persons. Cranks for operating the propulsion assembly are included on each side of the housing. Foot pedals are arranged on the cranks to enable operation by a single operator/occupant while sitting in the center of the boat and straddling the housing. Alternately, two persons may sit on either side of the boat. For a three or more person operation, the pedals are positioned to allow adjacent legs and feet of persons seated side-by-side and immediately adjacent one another to be extended and moved in unison for comfort and coordination.

33 Claims, 14 Drawing Figures

MANUALLY POWERED BOAT

BACKGROUND OF THE INVENTION

The present invention relates to manually powered boats, i.e., "paddle" or "pedal" boats, and, more particularly, to a foot pedal operated watercraft which is maintained in balanced floatation regardless of whether it is occupied by one, two, three or more operators. The watercraft is also designed for ease of operation when fully occupied.

Manually powered boats and watercraft especially of the foot pedal operated, paddle wheel type have long been known. Prior boats have used side or centrally mounted paddle wheels operable by hand or foot powered cranks either connected directly to the paddle wheels or through chain or other drives by one or more persons seated in the boat. Typical configurations for such boats include a pair of foot wells spaced on either side of a center console or housing over a paddle wheel, the foot wells being aligned with individual seats. A rudder control or other storage area is positioned between the seats. In such configuration, the boat remains balanced when occupied by two persons. However, when single person operation is desired, that person must sit on one or the other side of the center line of the boat causing an imbalance or "listing" of the boat which not only increases discomfort for the occupant, but also increases drag and decreases operating efficiency of the boat.

Another problem encountered with prior known pedal boats is the operation of the boat with three or more occupants. Many conventionally known designs do not include any seating area at the center of the boat in which a single operator can sit while controlling and operating the boat In those designs which accommodate a person centrally, as well as people on either side, many of the designs are quite cramped and confine those persons to a narrow area. Since the boat is operated manually, typically by extending and moving the legs, such cramped seating prevents effective, efficient operation, is very uncomfortable and inconvenient, and can even cause injury due to movement of adjacent legs in opposite directions.

The present invention was designed as a solution to the above and other problems typically encountered in prior known manually operated boats especially of the pedal or paddle wheel type.

SUMMARY OF THE INVENTION

The present invention provides a manually powered boat or watercraft which allows operation by one person seated in the center of the boat, two persons seated on either side of the boat, or three or more persons seated side-by-side across the width of the boat while the boat remains in proper balance and trim regardless of the number of occupants/operators. When the boat is operated by two or more persons seated immediately adjacent and side-by-side one another, manual operation means are provided which allow the adjacent extremities of such two persons to be moved and extended in unison to avoid adjacent reciprocating leg movement which could otherwise cause discomfort or injury.

In one form, the invention provides a manually powered boat of the type including a hull with a longitudinal center line, propulsion means for propelling the boat, at least one seat, and manually operated means operating the propulsion means. The manually operated means includes crank means for operating the boat by one or multiple persons. The crank means include an axis of rotation and a plurality of areas for operating the propulsion means on either side of the hull center line. At least one of the areas on each side of the center line includes means offset from the axis of rotation of the crank means for alternately receiving the extremities of one or two persons. The extremity receiving portions are positioned immediately adjacent and side-by-side one another in the offset position whereby immediately adjacent extremities of two persons seated side-by-side in the boat will be extended and moved in unison when operated by such two persons.

Preferably, the extremity receiving portions are foot pedal means which can receive either one foot or, alternately, two feet, one from each of two adjacent persons. In addition, the crank means preferably include a crank shaft having a plurality of offset areas therein each of which includes rotatably mounted foot pedals.

In another form of the invention, a manually powered boat is provided including a buoyant hull means, seat means for supporting at least three persons across the width of the boat, propulsion means for propelling the boat through the water, means for rotatably mounting the propulsion means on the hull means, and manual operation means connected to the propulsion means. In this form, the manual operation means are provided for each of at least three persons and include portions positioned for engagement by adjacent extremities of at least two persons seated immediately adjacent and side-by-side one another such that their adjacent extremities are in the same extended or retracted position simultaneously.

In other aspects of the invention, the manual operation means include central portions mounted for operation by a person seated on the center line in the seat means with his or her extremities extended and straddling a center support whereby the boat remains balanced during operation by only one person.

Preferably, the offset areas in the crank means or crank shaft are offset by 180 degrees from corresponding areas on the opposite side of the center line or center support of the boat. Further, a center support may include a housing on the hull which covers at least portions of a centered paddle wheel or other propulsion means. In such arrangement, one occupant may operate the boat by straddling the center housing.

The present invention provides numerous advantages over prior known manually operated watercraft. First, the boat may be operated by one, two, three or more persons while in every case remaining balanced and avoiding listing to one side or the other. Such balance enables more efficient operation, better contact of the manually operated propulsion means with the water, and less drag or resistance to movement for the boat through the water. Secondly, when multiple persons are seated side-by-side and immediately adjacent one another within the boat, manual operation is enhanced by provision of manual operation areas which are immediately adjacent one another and offset in the same position such that adjacent extremities from such two persons will be moved and extended simultaneously and in unison. Such operation avoids reciprocating motion of the extremities of immediately adjacent persons to prevent injury and provide greater comfort in the confined space of the boat.

These and other objects, advantages, purposes and features of the invention will become more apparent from a study of the following description taken in conjunction with the drawings.

Figure 1:
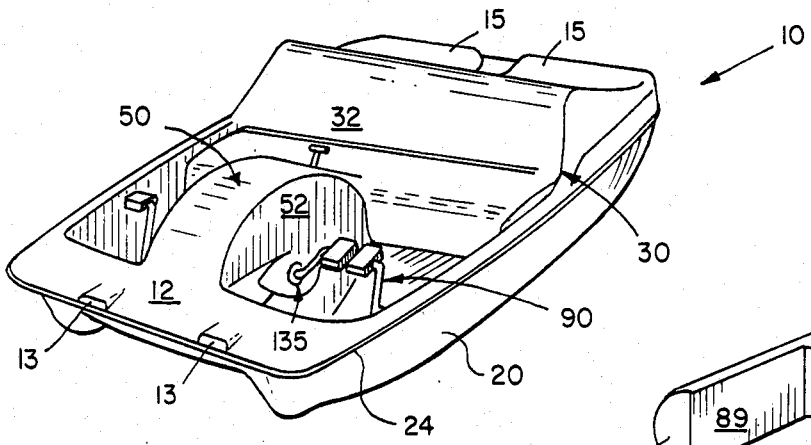
FIG. 1 is a front perspective view of a first embodiment of the manually powered boat embodying the present invention.
Figure 7A:
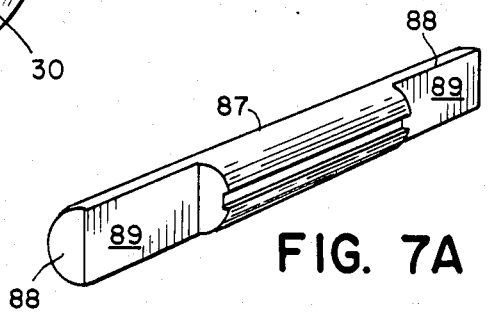
FIG. 7 is a front elevation of the paddle wheel and crank assemblies of the boat of FIGS. 1–6.
Figure 7:
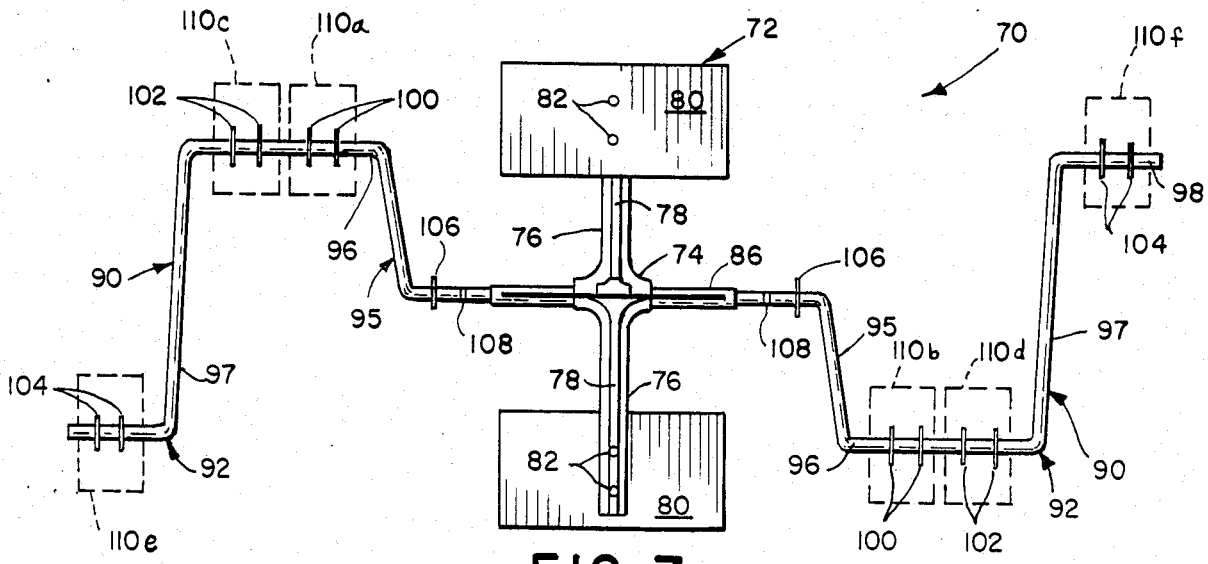
Figure 8:
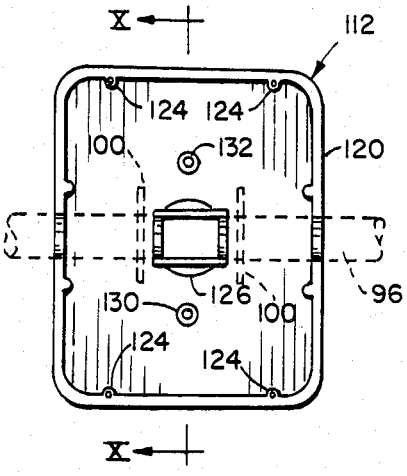
Figure 9:
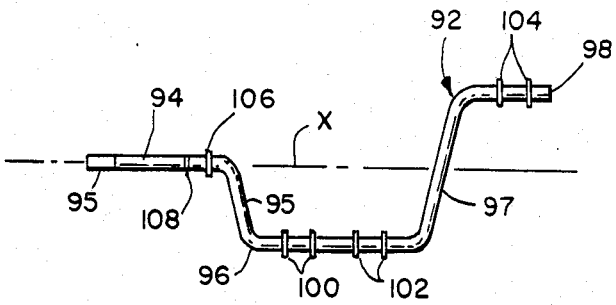
Figure 10:
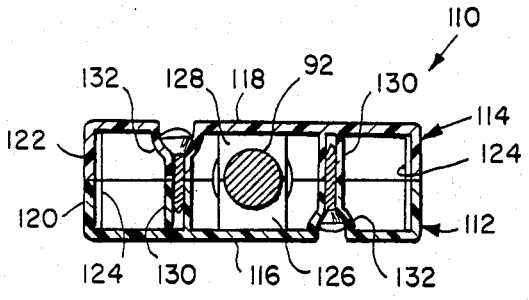
Figure 11:
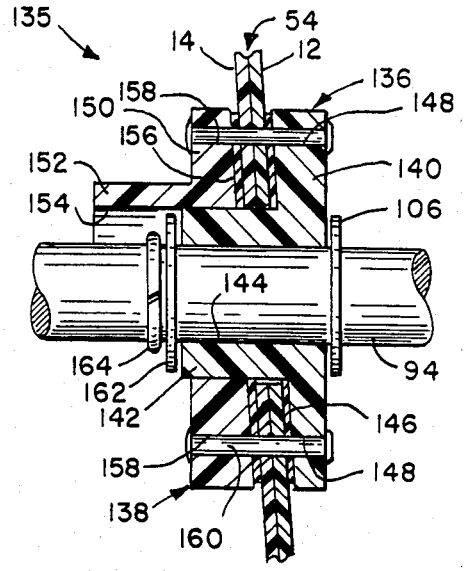
Figure 12:
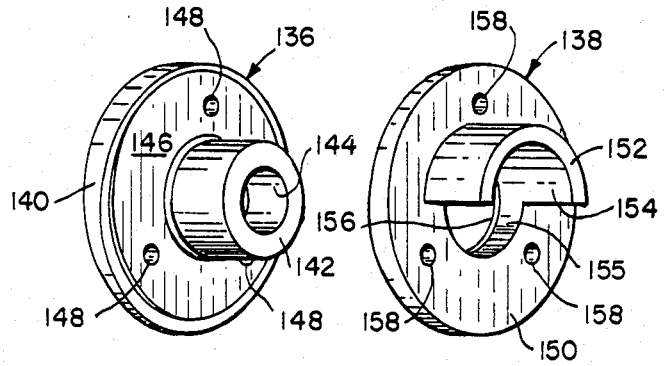
Figure 13:
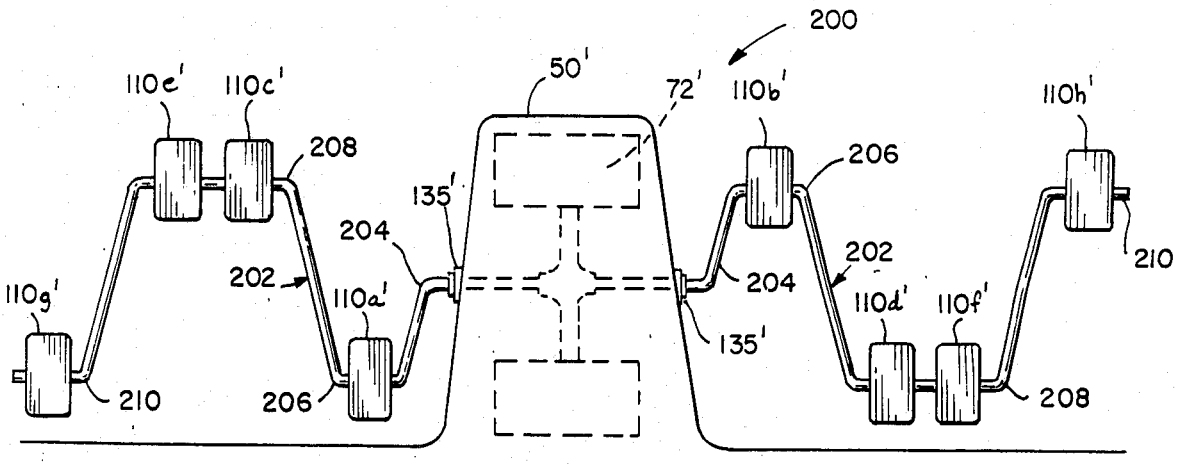

FIG. *7a* is a perspective view of the insert received within the hub of the paddle wheel to prevent the crank assemblies from rotating with respect to the paddle wheel;

FIG. 8 is a plan view of one-half of the preferred embodiment of the foot pedal assembly used in the boat of the present invention;

FIG. 9 is an elevation of one of the two opposing crank shafts adapted for connection to the paddle wheel as shown in FIG. 7;

FIG. 10 is a sectional side view of one of the rotatable foot pedal assemblies on a crank shaft taken along line X—X of FIG. 8;

FIG. 11 is a sectional elevation of one of the support bearings for the crank shaft and paddle wheel of the boat of FIGS. 1–6;

FIG. 12 is an exploded, perspective view of the bearing assembly of FIG. 11; and FIG. 13 is a front elevation of an alternate embodiment of the crank and paddle wheel assembly of the present invention.

DESCRIPTION OF THE PREFERRED EMBODIMENTS

Figure 2:
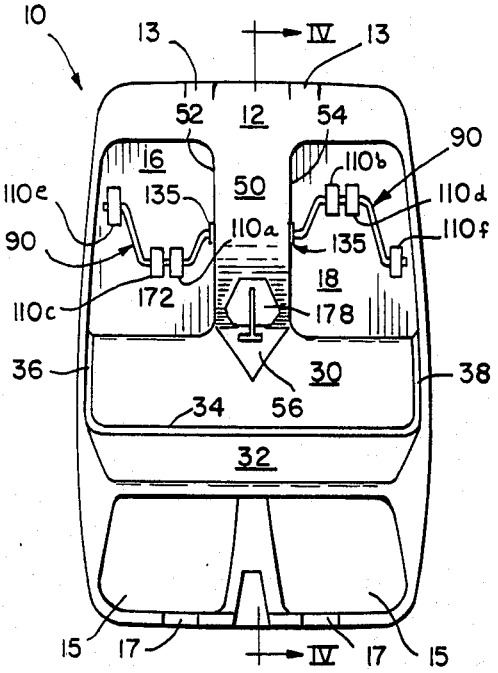
FIG. 2 is a top plan view of the manually powered boat of FIG. 1.
Figure 3:
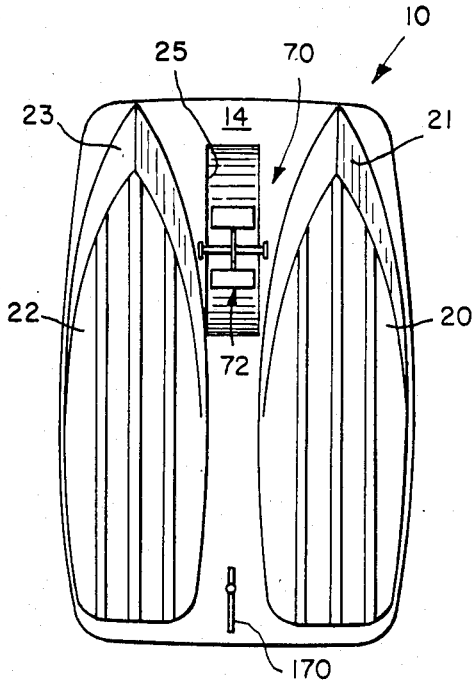
FIG. 3 is a bottom plan view of the manually powered boat of FIGS. 1 and 2.
Figure 4:
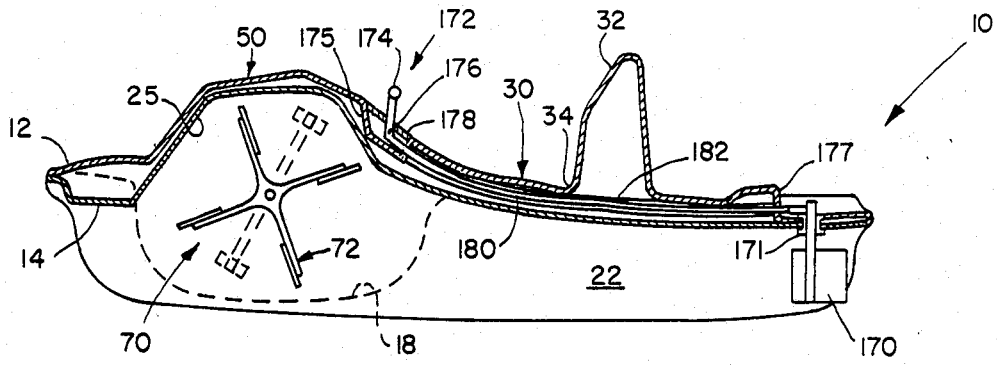
FIG. 4 is a side sectional view taken along the longitudinal center line IV—IV of FIG. 2.

Referring now to the drawings in greater detail, FIGS. 1–4 illustrate a first embodiment 10 of the manually operated watercraft or boat of the present invention. Boat 10 includes upper or deck and lower hull sections 12, 14, a bench-type seat 30 extending across the width of the boat, rear storage or seating areas 15 behind the back of seat 30, and a central housing 50 extending over a paddle wheel type propulsion assembly 70. Hull sections 12, 14 also include integrally molded front and rear handholds 13, 17 (FIGS. 1 and 2) for ease in handling the boat. Between the seat and the front of the boat on either side of central housing 50 are foot wells 16, 18 which are recessed within longitudinally extending pontoons 20, 22 formed in the lower hull section. When propulsion assembly 70, including the paddle wheel 72, is rotated with crank assemblies 90 by persons seated in the boat, the boat is pulled or pushed through the water forwardly or rearwardly. Directional control is provided by rudder 170 operated by rudder control assembly 172 mounted on the aft side of center housing 50 as shown in FIGS. 2 and 4.

When floated on a body of water, pontoons 20, 22 support the gunwale 24 of the boat substantially above the water yet allow the blades of paddle wheel 72 to completely engage the water for efficient propulsion. Similarly, the blade of rudder 170 is immersed in the water to provide proper directional control. Boat 10 may conveniently accommodate up to three adults and additional smaller persons. As explained below, the unique propulsion assembly 70 included in boat 10 enables balanced operation by one, two or three persons while maintaining the balance and trim of the craft without listing. In other embodiments, more than three persons can operate the boat while maintaining proper balance and trim. In each case, the immediately adjacent legs or extremities of adjacent operators are moved simultaneously and in unison in the same direction within the confined space in the boat.

As is best seen in FIGS. 1–4, upper hull or deck section 12 of boat 10 is molded from a single sheet of polymeric material, preferably high density polyethylene, and includes the various features described above which are integrally formed therein. Seat 30 is spaced behind foot wells 16, 18 a sufficient distance to accommodate the leg length of a range of persons such that their feet will easily engage the crank assemblies 90. At the rear of seat 30 an upstanding, contoured backrest 32 extends across substantially the entire width of the hull. Immediately aft of back 32 are storage areas 15 which may serve as additional seats for one or more persons depending on size.

Lower hull section 14 is likewise molded, preferably from a sheet of high density polyethylene, and includes spaced pontoons 20, 22 which have ribbed bottoms for increased strength as shown in FIG. 3. A recess 25 is molded upwardly and inwardly between the tapered prows 21, 23 of pontoons 20, 22 and receives rotatable paddle wheel 72 (FIGS. 3 and 4). The area of lower hull 14 which extends along the longitudinal center line of the boat 10 is spaced a few inches below the formed areas of upper hull 12 so as to provide a space for mounting of rudder control assembly 172 between housing 50 and rudder 170 as shown in FIG. 4 and as explained below. The upstanding sidewalls 52, 54 of central housing 50 taper slightly outwardly as they progress toward the bottom of foot wells 16, 18. Upper and lower hull sections 12, 14 are in engagement with one another along sidewalls 52, 54 as shown in FIG. 11. One or more expanded polystyrene floatation blocks (not shown) may be placed within the hollow areas of pontoons 20, 22 to aid in buoyancy and floatation for the boat.

Figure 6:
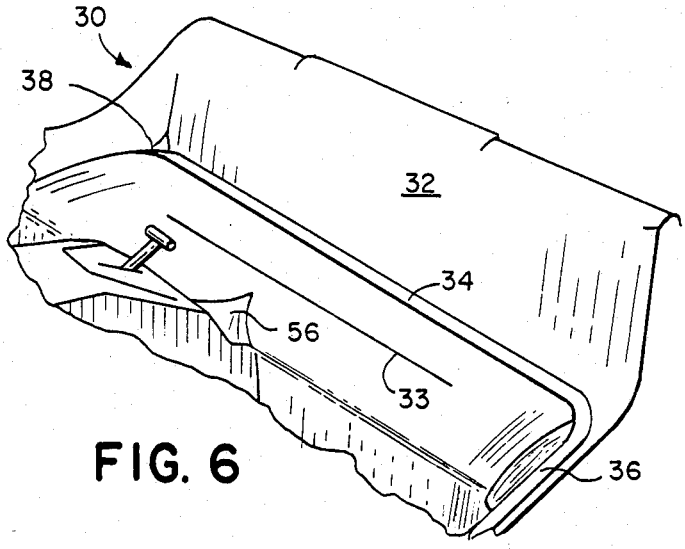
FIG. 6 is a fragmentary perspective view of the self-draining seat area of the boat of FIGS. 1–5.

As seen in FIGS. 1, 2, 4 and 6, seat 30 is of the bench type which extends transverse to the longitudinal center line of boat 10 across substantially the entire width of the boat. Seat 30 has a crowned or raised configuration as shown in FIGS. 4 and 6. In the preferred embodiment, when the boat has a width of slightly more than 64 inches, seat 30 may accommodate up to three adult persons comfortably. The crowned seat portion slopes downwardly toward the foot wells 16, 18 and toward the rear of the boat from a line 33 defining the highest area of the seat. A trough recess 34 extends along the back of the seat at the lower portion of seat back 32 and curves around the sides of the crowned seat to side trough recesses 36, 38 which slope toward foot wells 16, 18 as shown in FIGS. 2 and 6. The lower end of center housing 50 is rounded and blended into the seat area at 56 to allow water to drain downwardly along that area toward both foot wells 16, 18. Thus, when boat 10 is exposed to the rain, or water splashes within the interior of the boat, any water which falls on seat 30 will drain directly off the crowned seat into foot wells 16, 18 or rearwardly to trough 34 which conveys the water around the ends of the seat in trough recesses 36, 38 also into the foot wells. This allows the seat to drain itself automatically and remain substantially dry for use by persons within the boat.

Referring now to FIGS. 3–5 and 7, propulsion assembly 70 includes a four bladed paddle wheel 72 receiving a pair of oppositely extending crank assemblies 90 on either side thereof. Paddle wheel 72, preferably molded from nylon, includes a hub 74 (FIGS. 3, 4 and 7), four spokes 76, and reinforcing ribs 78 extending along either side of each of the spokes 76. The outer end of each spoke 76 has a flattened area on one side against which is placed a rectangular blade 80 secured by rivets 82. Spokes 76 project outwardly in equally spaced positions from a hub 74 which includes a cylindrical aperture extending completely therethrough receiving a steel tube 86. Tube 86 forms a socket on either end receiving crank assemblies 90 and receives a smaller diameter, "D" shaped, cylindrical insert 87 (FIG. 7*a*). Insert 87 includes semicircular "D" shaped ends 88 having flat surfaces 89 which match and correspond to the flat ends on crank assemblies 90. Insert 87 is positioned within tube 86 and welded or otherwise secured at the center of the tube. Crank assemblies 90 are telescopically fitted within tube 86 for rotation of the paddle wheel. Hence, rotation of crank assemblies 90 causes simultaneous rotation of the paddle wheel 72 such that blades 80 are pushed or pulled through the water.

Figure 5:
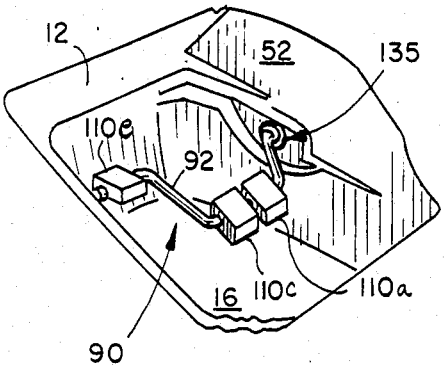
FIG. 5 is a fragmentary perspective view of one manually operated crank assembly for the boat of FIGS. 1–4.

Referring now to FIGS. 5, 7 and 9, each of the crank assemblies 90 includes a configured crank shaft 92 bent from steel rod and having an axis of rotation X defined by its inner end 94 (FIG. 9). Inner end 94 includes a semicircular, "D" shaped flat 95 which mates with flats 89 on insert ends 88 within tube 86 of paddle wheel 72 as described above. Crank shaft 92 extends outwardly from inner shaft end 94 and includes two areas 96, 98 which are offset from the axis of rotation X by connecting rod sections 95, 97. Offset areas 96, 98 extend parallel to axis X and are equally offset from that axis. Also included on each crank shaft 92 are three pairs of retaining washers 100, 102, 104 which are welded or otherwise secured at spaced positions within areas 96, 98 respectively. Thus, offset area 96 includes two spaced pair of washers 100, 102 while outer end offset area 98 includes washers 104. Washers 100, 102, 104 receive molded foot pedal assemblies 110 as described below. A retaining washer 106 at the outer portion of inner end 94 of crank shaft 92 is welded or otherwise secured adjacent connecting section 95. Further, an annular groove 108 extends around inner end 94 at a position spaced from washer 106 for receiving a retaining clip on the inside of walls 52, 54 for retaining the crank assemblies in place.

Referring now to FIGS. 7, 8 and 10, each of the crank shafts 92 is adapted to receive three foot pedal assemblies 110 as positioned by spaced washers 100, 102, 104. Each foot pedal assembly 110 includes a pair of mating foot pedal bodies or housings 112, 114 which include substantially planar foot receiving surfaces 116, 118 and surrounding sidewalls 120, 122. Pedal housings or bodies 112, 114 are preferably molded from a resinous polymeric material such as polypropylene. Surfaces 116, 118 may include treads or the like for better traction. Foot pedal housings 112, 114 each include mating projections and recesses 124 molded integrally with sidewalls 120, 122 at four spaced positions. Projections and recesses 124 automatically align the sidewalls as shown in FIG. 10 when pedals 110 assemble around crank shaft 92. In order to provide rotation and pivotal movement around the crank shafts, a pair of molded bearing halves 126, 128, one in each of the pedal body sections 112, 114, is provided. Bearing halves 126, 128 enclose the crank shaft rod but have a length less than the distance between washer pairs 100, 102, 104 such that the assembled foot pedal is retained in position by the washer pairs. In order to retain the two pedal body portions together, molded, aligned screw receiving cylinders 130, 132 are provided in the pedal halves for receiving securing screws. Screw receiving cylinders 132 include recessed ends so that the screws do not project above the surfaces 116, 118 when assembled (FIG. 10). Thus, when assembled around the various areas of crank shaft 92, foot pedal assemblies 110 provide a firm gripping area for the operator's feet and rotate with respect to the crank shaft such that the crank shaft may be pushed and rotated about axis X.

As shown in FIGS. 1, 2, 5, 11 and 12, propulsion assembly 70 is rotatably supported with paddle wheel 72 positioned on the center line of boat 10 under housing 50 within recess 25. Crank assemblies 90 project outwardly from paddle wheel 72 and either housing wall 52, 54 and are rotatably supported with paddle wheel 72 by a pair of axially aligned bearing assemblies 135 (FIGS. 11 and 12). Each bearing assembly 135 extends through the double hull sections and includes a pair of mating bearing members 136, 138 also molded from nylon or a similar polymeric material which is resistant to corrosion and degradation due to weather exposure. Bearing member 136 includes an annular flange 140 which is tapered in section and is thinner at its lower edge as shown in FIG. 11. Extending inwardly from flange 140 is a cylindrical projection 142 having a cylindrical inner bearing surface 144 which receives and supports the outer surface of inner crank shaft end 94 as shown in FIG. 11. An annular ring or layer of polymeric, foam material 146 is applied to the inner surface of flange 140 around projection 142 to sealingly engage the outer surface of walls 52, 54 to prevent water from seeping into the bearing assembly. A series of three equally spaced fastening apertures 148 is also provided through flange 140 and foam layer 146.

Bearing member 138 likewise has an annular flange 150 which is tapered in section but opposite to that of tapered flange 140. The mating tapers of flanges 140, 150 correspond to the outward angle of walls 52, 54 such that bearing surface 144 will be substantially horizontal when bearing assembly 135 is fitted in the support walls as shown in FIG. 11. Extending outwardly from flange 150 is a semicircular protective flange 152 which has an inner surface 154 coextensive with the inner surface of an aperture 155 extending through flange 150. Surface 154 receives the outer diameter of projection 142 on bearing member 136 when the members are fitted together through the hull wall. Like bearing member 136, flange 150 includes an annular ring or layer of foam 156 on its inner surface for sealingly engaging the inner hull wall 14 to prevent water seepage into the bearing. In addition, securing apertures 158 are provided at three spaced locations in registry with apertures 148 for receipt of rivets 60 or other fasteners to hold the bearing assembly in place on the support walls 52, 54. Each wall 52, 54 is provided with an aperture having a size corresponding to the outer diameter of bearing projection 142 through both hull sections 12, 14 to mount the bearing assemblies. Protective flange 152 covers the upper half of the crank rod 94 when received through bearing assembly 135 to prevent water from splashing onto the bearing area and the crank.

After bearing assemblies 135 are positioned within hull walls 52, 54, paddle wheel 72 is positioned within recess 25 and one end 94 from each of the two crank assemblies 90 is telescoped through projection 142 on surface 144 and through an additional washer 162 positioned at the inner end of projection 142 until retaining washer 106 contacts the outside surface of flange 140 on assembly 135. End 94 is then telescoped within tube 86 of paddle wheel 72 for engagement with insert 87. Thereafter, a retaining clip 164 is inserted in groove 108 on each of the crank assemblies thereby retaining the paddle wheel centered in recess 25 because of washers 106, 162 and retaining clip 164, while retaining clips 164 prevent outward removal of the crank assemblies from the bearing assemblies 135.

With propulsion assembly 70 rotatably mounted in boat 10 as described (FIG. 7), it will be seen that corresponding areas 96 and 98 on opposite sides of housing 50 are offset by 180 degrees from one another. Also, double pedal offset areas 96 are positioned closest to housing 50. The outer ends 98 of crank assemblies 90 are not supported. Rather, they freewheel about axis X near the sides of boat 10 in foot wells 16, 18. The strength and rigidity of crank shafts 92 avoids the need for any bearings at those outside ends which reduces cost and assembly expense.

Directional control for boat 10 is provided through rudder 170 and rudder control assembly 172. Rudder 170 is mounted in a journal bearing 171 which extends through deck 12 and lower hull 14 (FIG. 4). As shown in FIGS. 2 and 4, rudder control assembly 172 includes a control handle 174 pivotally mounted at 176 on a cover plate 178 mounted on the rear side of center housing 50. Handle 174 extends downwardly into a recess 175 in deck 12 and is pivotally connected to a longitudinally stiff but laterally flexible rod or tube 180 by means of a clevis pin. Rod 180 extends and slides back and forth through a shielding tube 182 which is secured to a wall of recess 175 through which it passes. The aft end of rod 180 and tube 182 pass through a wall of another recess 177 positioned over rudder 170. The aft end of rod 180 is connected by another clevis pin to a bell crank or other lever mounted on the vertical post of rudder 170. Accordingly, fore and aft movement of handle 174 on pivot 176 results in fore and aft movement of control rod 180 through tube 182 which, in turn, rotates rudder 170 about its vertical axis for directional control of the boat when propulsion assembly 70 is operated. It will be understood that none of the rudder control assembly projects below the lower hull 14, but rather extends between the two hulls in a protected area as shown in FIG. 4. This avoids any through hull fittings except at the rudder connection which could allow water from the propulsion/paddle wheel recess 25 to be splashed into foot wells or other areas interior of the boat. In addition, control assembly 172 does not extend downwardly into the water between the pontoons 20, 22 which would otherwise create drag or resistance to travel through the water.

Operation of the manually powered boat 10 with one, two or three operators will now be apparent. For single person operation, the operator is seated along the longitudinal center line of the boat in the middle of bench-type seat 30. The single operator's legs are extended on either side of central housing 50 such that he or she straddles that housing with his or her feet engaging foot pedals 110*a* and 110*b* on either side of the central housing (FIGS. 2 and 7). Since foot pedals 110 are mounted in offset areas 96, 98 of crank assemblies 90 which are offset 180 degrees from one another (FIG. 2), the single operator may rotate paddle wheel 72 to move the boat through the water by alternately extending his or her legs and pushing on foot pedals 110*a*, 110*b*. When seated in this position, the contoured area 56 at the lower, rear side of housing 50 prevents chafing of the operator's legs to allow proper foot pedal operation. Moreover, when seated in this position, the boat is maintained in proper balance and trim in the water and does not list or tip to either side. Passengers may be seated on either side of the single operator and need not participate in the foot operation of the boat when the single operator is seated in the center.

When operation by two persons is desired, they may be seated on either side of the center housing 50 on the left and right hand portions of seat 30. Their legs are extended and engage the lateral outside pairs of foot pedals, namely, 110*e* and 110*c* and 110*d* and 110 *f* respectively. The center pair of pedals 110*a*, 110*b* is not utilized when two persons are operating the boat. When seated and operating in this manner, the boat also remains balanced and in proper trim since weight is evenly distributed on either side of the center line. The bench seat helps in such balancing by allowing persons to move laterally without restriction along the bench to adjust such trim.

When three person operation is desired, the operators may be seated immediately adjacent one another and side-by-side across the entire width of seat 30 with the person in the center having his legs straddle housing 50 and engage pedals 110*a*, 110*b*. The left and right hand persons utilize foot pedals 110*e*, 110*c* and 110*d*, 110*f*, respectively. The adjacent legs of the operators will, however, operate in unison on each side of the center line of the boat as will be apparent from FIG. 2. Thus, the immediately adjacent legs of the center and left operator will engage foot pedals 110*c* and 110*a* and move outwardly away from the seat and back toward the seat in unison simultaneously at all times when three persons are manually pedaling the boat. Likewise, the right leg of the center operator and the left leg of the right hand operator will engage foot pedals 110*b* and 110*d* while three persons are operating boat 10. Again, those immediately adjacent leg extremities are moved outwardly and extended in unison simultaneously. The above operation, which is made possible by the adjacent, side-by-side positioning of a pair of foot pedals in each offset area 96 of crank assemblies 90, prevents reciprocating movement of legs of adjacent persons which could otherwise cause injury or be extremely uncomfortable in the narrow, confined space of the boat 10. Indeed when larger adults are seated across seat 30, unless adjacent legs of the persons are operated in unison as described above, it is difficult for all three occupants to pedal or operate the boat at the same time. As with one and two person operation, the boat again remains balanced and in trim without listing to either side because weight is evenly distributed on the center line and to the left and right thereof during three person operation. Additional persons can be seated in the areas 15 behind seat 30 if desired.

An alternate embodiment of the propulsion assembly for use in a boat such as boat 10 is shown in FIG. 13. Propulsion assembly 200 includes a paddle wheel 72' like paddle wheel 72 described above surrounded by a housing 50' centered on the center line of the boat as above. Bearing assemblies 135' are mounted on either side of housing 50' for supporting crank assemblies 202 which extend outwardly from the housing and are connected to paddle wheel 72 in the same manner as described above for propulsion assembly 70. However, instead of being adapted for one to three operators, embodiment 200 is adapted for use by up to four operators. In this instance, crank assemblies 202 on either side of housing 50' can accommodate four feet on either side of the boat center line.

Each crank assembly 202 includes a crank shaft 204 having three offset areas 206, 208, 210. These offset areas are spaced from the axis of rotation which extends through bearings 135' by an equal distance on either side thereof with offset area 208 being opposite offset areas 206, 210. In addition, the corresponding offset areas on either side of housing 50' as one progresses outwardly from either side of housing 50' are offset 180 degrees from one another as shown in FIG. 13. In addition, instead of the first offset area on either side of housing 50' including an adjacent pair of foot pedals, embodiment 200 spaces the double foot pedal offset area 208 at a position intermediate areas 206, 210 on either side of housing 50'. Thus, two persons may be accommodated on either side of housing 50'. One person using the outer two pedals **110*g'*, 110*e'* or 110*f'*, 110*h'* which are offset from one another while the other person uses the inner two pedals 110*c'*, 110*a'* or 110*b'*, 110*d'* which are also offset from one another. Since the two foot pedals in offset area 208 are offset in the same position from the axis of rotation, the two persons on either side of housing 50'** who may wish to operate the boat may do so simultaneously while their legs are extended and moved in unison toward, around and away from the axis of rotation so that no reciprocal motion of adjacent extremities from such persons is encountered.

For single person operation, embodiment 200 may be used similarly to propulsion assembly 70 where a single person sits on the center line of the boat in which propulsion assembly 200 is mounted and straddles housing 50' with his left foot engaging foot pedal **110*a'* and his right foot engaging pedal 110*b'***.

For two person operation of embodiment 200, one person may sit on either side of housing 50' and use either the inner or outer pairs of pedals. For three person operation, one person sits on the center line of the boat and straddles housing 50' using foot pedals **110*a'*, 110*b'*, while two additional persons may sit one on either side of housing 50' and use pairs of foot pedals 110*g'*, 110*e'* and 110*f'*, 110*h'*. Pedals 110*c'* and 110*d'*** are not used for such three person operation.

Accordingly, in all cases, regardless of whether one, two, three or four persons operate assembly 200, the balance and trim of the boat in which that assembly is mounted remains proper without listing to either side because of the ability to space and seat operators on either side of the center line with foot pedals being appropriately located for their use. As with embodiment 70, it is not necessary to support the outer ends 210 of crank assemblies 202 since the outer ends merely freewheel adjacent the sides of the boat foot wells with the stiffness of crank shafts 204 providing sufficient support for rotational operation. This eliminates the need for outer bearing assemblies and reduces the overall expense of the propulsion assembly.

Although propulsion assemblies 70, 200 include separate, side-by-side pedals 110 in double pedal areas 96, 208, it is possible to substitute a single larger foot pedal large enough to receive two feet side-by-side on one pedal surface in such areas. Such a pedal would allow the same operation by one or multiple persons.

Accordingly, with either propulsion assembly 70 or 200 in the manually powered boat, operation by persons seated immediately adjacent one another while having their legs or extremities move and extend in unison simultaneously is made possible by the mounting of foot pedals in the same offset areas. In addition, either embodiment enables operation by one or multiple persons while maintaining the boat in proper balance and trim.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A manually powered boat comprising:

buoyant hull means for floating said boat on water, said hull means having a longitudinal center line, extending therealong;

seat means for supporting at least three persons transversely across the width of said boat;

propulsion means for engaging the water for propelling said boat through the water;

means for rotatably mounting said propulsion means on said hull means;

manual crank means extending to either side of said center line and connected to said propulsion means for rotating said propulsion means to propel said boat; support means for supporting said manual crank means; said manual crank means having an axis of rotation and including extending portions having a plurality of extremity engaging areas on each side of said center line which are offset from said axis of rotation; each of said extremity engaging areas having at least one extremity engaging means thereon for receiving an operator's extremity to operate said manual crank means and propulsion means; a predetermined one of said extremity engaging areas on each side of said center line including first extremity engaging means for engagement by adjacent extremities of at least two persons who are seated immediately adjacent and side-by-side one another on said seat means such that their adjacent extremities will be moved in unison during operation of said boat; the extremity engaging areas which are on opposite sides of said center line and which are closest to and immediately adjacent said center line being offset across said axis of rotation from one another.

2. The boat of claim 1 wherein said support means includes a center support for said manual crank means generally along said center line; said extremity engaging means in said extremity receiving areas closest to said center line being adapted for operation by a person seated on said center line in said seat means with his or her extremities extended and straddling said center support whereby said boat remains balanced in the water during operation by only one person.

3. The boat of claim 2 wherein said extremity engaging areas include a plurality of pedal receiving areas on said crank means on each side of said center support; each of said pedal receiving areas on one side of said center support being spaced at different distances from said center support and offset by 180 degrees from the corresponding area which is spaced a similar distance from said center support on the opposite side of said center support.

4. The boat of claim 3 wherein each of the pedal receiving areas which includes said first extremity engaging means is positioned closer to said center support than any other pedal receiving areas on its respective side of said center support.

5. The boat of claim 4 wherein said propulsion means are rotatably mounted along said center line; said center support including a housing on said hull extending over and shielding said propulsion means; said housing including spaced, generally upright walls, said manual crank means including a pair of crank shafts extending in opposite directions; one of said crank shafts extending through one of said upright walls, the other of said crank shafts extending through the other of said upright walls.

6. The boat of claim 5 wherein said means for rotatably mounting said propulsion means include bearing means mounted on said upright walls; said propulsion means including a paddle wheel within said housing; said crank shafts joined to said paddle wheel and mounted on said bearing means.

7. The boat of claim 6 wherein said crank shafts each include first and second pedal receiving areas offset from said axis of rotation and at least three foot pedals rotatably mounted thereon; said first extremity engaging means being dual foot pedal means including two of said foot pedals mounted side-by-side on said first pedal receiving area; the remaining foot pedal mounted on said second foot pedal area.

8. The boat of claim 3 wherein said propulsion means are rotatably mounted along said center line; said center support including a housing on said hull extending over and shielding said propulsion means; said housing including spaced, generally upright walls; said crank means including a pair of crank shafts extending in opposite directions; one of said crank shafts extending through one of said upright walls, the other of said crank shafts extending through the other of said upright walls; said means for rotatably mounting said propulsion means include bearing means mounted on said upright walls; said propulsion means including a paddle wheel within said housing; said crank shafts joined to said paddle wheel and mounted on said bearing means; said crank shafts each including at least three pedal receiving areas offset from said axis of rotation and at least four foot pedals rotatably mounted thereon; said first extremity engaging means being dual foot pedal means including two of said foot pedals mounted side-by-side on a first pedal receiving area; one of the remaining two pedals mounted on each of the remaining two pedal receiving areas; said first pedal receiving area being intermediate said remaining two pedal receiving areas.

9. The boat of claim 1 wherein said manual crank means include a pair of crank shafts one on each side of said center line; said first extremity engaging means being rotatably mounted on a first extremity engaging area of said crank shafts; each of said crank shafts including at least one second extremity engaging area including second extremity engaging means rotatably mounted thereon for receiving at least one extremity of an operator.

10. The boat of claim 9 wherein said first extremity engaging means includes a pair of foot pedals mounted side-by-side on said first extremity engaging area of said crank shaft; said second extremity engaging means including one foot pedal mounted on said second extremity engaging area; each of said foot pedals including a pedal body and bearing means for engaging and rotatably supporting said pedal body on said crank shaft.

11. The boat of claim 10 wherein each of said pedal bodies includes a two-part, hollow housing fitted around said crank shaft and engaging retaining means on said crank shaft for locating said foot pedals thereon.

12. The boat of claim 9 wherein said propulsion means include a paddle wheel; said paddle wheel including socket means for receiving said crank shafts on either side thereof; said socket means and crank shafts including cooperating means for preventing rotation of said crank shafts with respect to said paddle wheel.

13. The boat of claim 1 wherein said means for rotatably mounting said propulsion means include bearing means mounted on said hull means; said bearing means including shaft engaging surface means extending through said hull means, flange means extending over at least a portion of said manual crank means for protecting said manual crank means against water from said propulsion means, and fastener means extending through said hull means for securing said bearing means thereon.

14. A manually powered boat comprising:

a buoyant hull having a longitudinal center line;

seat means extending transversely of said center line for supporting at least three persons across the width of said boat;

propulsion means mounted on said hull along said center line for engaging the water for propelling said boat through the water;

a central housing extending generally along said center line and covering at least a part of said propulsion means;

foot operated, rotational crank means extending to either side of said central housing and operably connected to said propulsion means for operating said propulsion means; said crank means having an axis of rotation and including a plurality of pedal receiving areas on each side of said center housing which are offset from said axis; each of said pedal receiving areas having at least one foot pedal means thereon for receiving an operator's foot to operate said crank means and propulsion means; at least one of said pedal receiving areas on each side of said central housing being a dual receiving area and including foot pedal means for receiving a pair of feet positioned immediately adjacent and side-by-side one another, the pair of feet being from adjacent legs of each of two operators seated adjacent and side-by-side one another on said seat means whereby such adjacent legs will be moved in unison during operation of said boat; the pedal receiving areas which are on opposite sides of said central housing and which are closest to and immediately adjacent said central housing being offset oppositely from one another across said axis of rotation of said crank means and having foot pedal means thereon for receiving at least one foot from an operator whereby a single operator with his or her legs extending on either side of said central housing can operate said crank means alone while seated along the center line of said boat or together with other operatore when they are on one or the other side of said center line.

15. The boat of claim 14 wherein each of said dual pedal receiving areas of said crank means are positioned closer to said center housing than any other of said offset areas on said respective sides of said center housing whereby a single person seated on said center line in said seat means with his or her extremities extended and straddling said central housing can operate said boat and maintain the balance of said boat in the water.

16. The boat of claim 14 wherein each of said pedal receiving areas on one side of said central housing is offset by 180 degrees from the corresponding pedal receiving area on the opposite side of said central housing.

17. The boat of claim 14 wherein said central housing includes spaced, generally upright walls; said crank means including a pair of crank shafts extending in opposite directions; one of said crank shafts extending through one of said upright walls, the other of said crank shafts extending through the other of said upright walls.

18. The boat of claim 17 including bearing means mounted on each of said upright walls for rotatably mounting said crank shafts.

19. The boat of claim 18 wherein each of said bearing means include shaft engaging surface means extending through said hull means, flange means extending over at least a portion of said crank shaft for protecting said crank shaft and bearing means against water from said propulsion means, and fastener means extending through said hull means for securing said bearing means thereon.

20. The boat of claim 18 wherein said propulsion means includes a paddle wheel within said housing; said crank shafts joined to said paddle wheel and mounted on said bearing means.

21. The boat of claim 20 wherein said crank shafts each include at least two pedal receiving areas offset from said axis of rotation and at least three foot pedals rotatably mounted thereon; said foot pedal means including two of said foot pedals mounted side-by-side on said dual pedal receiving area which includes said foot pedal means for receiving a pair of feet and the remaining foot pedal mounted on the remaining pedal receiving area; said dual pedal receiving area and said remaining pedal receiving area being offset from one another across said axis of rotation of said crank means.

22. The boat of claim 20 wherein said crank shafts each include at least three pedal receiving areas offset from said axis of rotation and at least four foot pedals rotatably mounted thereon; said foot pedal means including two of said foot pedals mounted side-by-side on said dual pedal receiving area; one of the remaining two pedals mounted on one of the remaining two pedal receiving areas; the other of the remaining two pedals mounted on the other of the remaining two pedal receiving areas; said dual pedal receiving area being intermediate and offset oppositely across said axis or rotation from said remaining two pedal receiving areas.

23. The boat of claim 20 wherein said paddle wheel includes socket means for receiving said crank shafts on either side thereof; said socket means and crank shafts including cooperating means for preventing rotation of said crank shafts with respect to said paddle wheel.

24. The boat of claim 14 wherein said foot pedal means are rotatably mounted on said crank means; each of said crank means including at least one second area on each side of said center housing including second foot pedal means rotatably mounted thereon for receiving at least one foot from an operator.

25. The boat of claim 24 wherein said foot pedal means includes a pair of foot pedals mounted side-by-side on said dual pedal receiving area of said crank means; said second foot pedal means including one foot pedal mounted on said second area; each of said foot pedals including a pedal body and bearing means for engaging and rotatably supporting said pedal body on said crank means.

26. In a manually powered boat of the type including a hull having a longitudinal center line, propulsion means for propelling the boat, at least one seat, and manually operated means for operating the propulsion means, the improvement comprising:

the manually operated means including crank means for operating said boat by one or multiple persons, said crank means being operably connected to said propulsion means, having an axis of rotation, and including a plurality of extremity receiving areas for operating said propulsion means on either side of the hull center line, at least one of said extremity receiving areas on each side of the center line including first means offset from said axis of rotation for alternately receiving the extremities of one or two persons, said first means having extremity receiving portions positioned immediately adjacent and side-by-side one another in said offset position such that the immediately adjacent extremities of two persons seated side-by-side in said boat will be extended and moved in unison when operated by such two persons; one of said extremity receiving areas on one side of said center line being adjacent and closest to said center line and offset across said axis of rotation from the corresponding extremity receiving area closest to said center line on the other side of said center line; each of said extremity receiving areas closest to said center line including extremity receiving means offset from said axis of rotation for receiving the extremity of a person whereby a single operator with his or her legs extending on each side of said center line can operate said crank means alone while seated along the center line of said boat or, alternately, can operate said crank means together with other operators when they are on one or the other side of said center line.

27. The improvement of claim 26 wherein said first means on each side of the center line are offset by 180 degrees from one another.

28. The improvement of claim 26 wherein said first means include foot pedal means for receiving either one foot or, alternately, two feet from adjacent legs of persons seated immediately adjacent and side-by-side in said boat.

29. The improvement of claim 28 wherein said crank means includes a crank shaft having a plurality of areas thereon offset from said axis of rotation; said foot pedal means including a pair of foot pedals rotatably mounted immediately adjacent and side-by-side one another on one of said offset crank shaft areas.

30. The improvement of claim 29 wherein each of the other offset areas on said crank shaft include foot pedal means for receiving at least one foot from an occupant.

31. The improvement of claim 26 wherein said first means are located in said extremity receiving areas closest to but on opposite sides of said hull center line.

32. A manually powered boat comprising:

a hull having a longitudinal center line;

seat means extending transversely of said center line for supporting at least three persons across the width of said boat;

propulsion means mounted on said hull along said center line for engaging the water for propelling said boat through the water;

a central housing extending generally along said center line and covering at least a part of said propulsion means:

a pair of foot operated, rotational cranks, one crank extending to each side of said central housing, said crank being operably connected to said propulsion means for operating said propulsion means and having an axis of rotation; each crank including at least two pedal receiving areas offset from one another across said axis of rotation, a first of said areas on each crank being adjacent said center line; the second of said areas on each crank being adjacent said first area; said first area having foot pedal means for receiving a pair of feet positioned adjacent and side-by-side one another, the pair of feet being from adjacent legs of each of two operators seated adjacent and side-by-side one another on said seat means whereby such adjacent legs will be moved in unison during operation of said boat; said second area including foot pedal means for receiving one foot of an operator; said first areas on opposite sides of said center line being offset across said axis of rotation from one another whereby a single operator with his or her legs extending on either side of said central housing can operate said cranks alone while seated along the center line of said boat or together with other operators when they are on one or the other side of said center line.

33. A manually powered boat comprising:

a hull having a longitudinal center line;

seat means extending transversely of said center line for supporting at least three persons across the width of said boat;

propulsion means mounted on said hull along said center line for engaging the water for propelling said boat through the water;

a central housing extending generally along said center line and covering at least a part of said propulsion means;

a pair of foot operated, rotational cranks, one crank extending to each side of said central housing, said cranks being operably connected to said propulsion means for operating said propulsion means and having an axis of rotation; each crank including at least three pedal receiving areas offset from one another across said axis of rotation, a first of said areas on each crank being adjacent said center line; the second and third of said areas on each crank being spaced successively from said central housing outwardly of said area; said first area having foot pedal means for receiving a foot of an operator; said third area having foot pedal means for receiving a foot of another operator; said second area having foot pedal means for receiving a pair of feet positioned adjacent and side-by-side one another, the pair of feet being from adjacent legs of each of two operators seated adjacent and side-by-side one another on said seat means whereby such adjacent legs will be moved in unison during operation of said boat; said first areas on opposite sides of said center line being offset across said axis of rotation from one another whereby a single operator with his or her legs extending on either side of said central housing can operate said cranks alone while seated along the center line of said boat or together with other operators when they are on one or the other side of the said center line.

* * * * *

UNITED STATES PATENT AND TRADEMARK OFFICE

CERTIFICATE OF CORRECTION

PATENT NO. : 4,668,196

DATED : May 26, 1987

INVENTOR(S) : Charles E. Billmayer and Robert P. Koch

It is certified that error appears in the above-identified patent and that said Letters Patent is hereby corrected as shown below:

Column 2, line 33:

"simu1taneously" should be --simultaneously--

Column 5, line 29:

"te1escopically" should be --telescopically--

Column 6, line 67:

"60" should be --160--

Column 9, line 34:

"110f" should be --110f'--

Column 9, line 58:

"110f" should be --110f'--

Column 12, line 58, claim 14:

After "dual" insert --pedal--

Column 13, line 8, claim 14:

"operatore" should be --operators--

UNITED STATES PATENT AND TRADEMARK OFFICE

CERTIFICATE OF CORRECTION

PATENT NO. : 4,668,196

SHEET 2 OF 2

DATED : May 26, 1987

INVENTOR(S) : Charles E. Billmayer and Robert P. Koch

It is certified that error appears in the above-identified patent and that said Letters Patent is hereby corrected as shown below:

Column 16, line 24, claim 33:

After "said" (first occurrence) insert --first--

Signed and Sealed this

Sixth Day of October, 1987

*Attest:*

DONALD J. QUIGG

*Attesting Officer*

*Commissioner of Patents and Trademarks*

REEXAMINATION CERTIFICATE (991st)

United States Patent [19]

[11] B1 4,668,196

Billmayer et al.

[45] Certificate Issued Jan. 10, 1989

[54] MANUALLY POWERED BOAT

[75] Inventors: Charles E. Billmayer; Robert P. Koch, both of Grand Rapids, Mich.

[73] Assignee: Leisure Life Limited, Grand Rapids, Mich.

Reexamination Request:
No. 90/001,498, Apr. 21, 1988

Reexamination Certificate for:

| | |
|---|---|
| Patent No.: | 4,668,196 |
| Issued: | May 26, 1987 |
| Appl. No.: | 833,348 |
| Filed: | Feb. 25, 1986 |

Certificate of Correction issued Oct. 6, 1987.

[51] Int. Cl.[4] ..... B63H 5/02
[52] U.S. Cl. ..... 440/26; 440/27; 440/90; 114/61
[58] Field of Search ..... 440/26, 27

[56] References Cited

U.S. PATENT DOCUMENTS

| | | | |
|---|---|---|---|
| 2,299,737 | 10/1942 | Clark | 114/283 |
| 2,824,539 | 2/1958 | Budney et al. | 440/26 |
| 3,045,636 | 7/1962 | Thomas et al. | 440/26 |

OTHER PUBLICATIONS

"Sun Dolphin Brochure", K. L. Industries, Inc., 3551 Three Mile Rd., N.W., Grand Rapids, Michigan 49504.

*Primary Examiner*—Sherman D. Basinger

[57] ABSTRACT

A manually powered boat for use as desired by one, two, three or more operators is disclosed. Balanced floatation is maintained regardless of the number of occupants/operators. The boat includes a buoyant hull, a centered, rotatable propulsion assembly enclosed in a housing, and a seat for at least three persons. Cranks for operating the propulsion assembly are included on each side of the housing. Foot pedals are arranged on the cranks to enable operation by a single operator/occupant while sitting in the center of the boat and straddling the housing. Alternately, two persons may sit on either side of the boat. For a three or more person operation, the pedals are positioned to allow adjacent legs and feet of persons seated side-by-side and immediately adjacent one another to be extended and moved in unison for comfort and coordination.

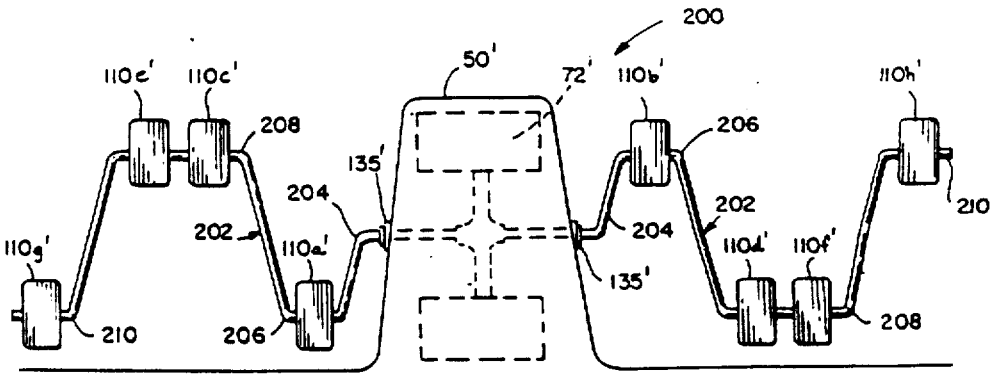

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8, 13, 19, 22 and 33 is confirmed.

Claims 1–7, 9–12, 14–18, 20, 21 and 23–32 are cancelled.

New claim 34 is added and determined to be patentable.

*34. A manually powered boat comprising:*

*buoyant hull means for floating said boat on water, said hull means having a longitudinal center line, extending therealong;*

*seat means for supporting at least three persons transversely across the width of said boat;*

*propulsion means for engaging the water for propelling said boat through the water;*

*means for rotatably mounting said propulsion means on said hull means;*

*manual crank means extending to either side of said center line and connected to said propulsion means for rotating said propulsion means to propel said boat; support means for supporting said manual crank means; said manual crank means having an axis of rotation and including extending portions having at least three extremity engaging areas on each side of said center line which are offset from said axis of rotation; the first of said areas on each side of said center line being closest to and immediately adjacent said center line and being offset across said axis of rotation from one another; said first areas each including first extremity engaging means for receiving an operator's extremity to operate said manual crank means and propulsion means; said second extremity engaging areas on each side of said center line including second extremity engaging means for engagement by adjacent extremities of at least two operators who are seated immediately adjacent and side-by-side one another on said seat means such that their adjacent extremities will be moved in unison during operation of said boat; the third extremity engaging areas on each side of said center line including third extremity engaging means for receiving an extremity of an operator different from the operator of said first area on each side to operate said manual crank means and propulsion means; said second and third areas on each side of said center line being spaced successively from said center line outwardly of said first area; said second extremity receiving areas being offset oppositely across said axis of rotation from said first and third areas on each side of said center line.*

* * * * *